US005727764A

United States Patent [19]

Angeles

[11] Patent Number: 5,727,764

[45] Date of Patent: Mar. 17, 1998

[54] SELF-LOCKING QUICK RELEASE BRACKET

[75] Inventor: James P. Angeles, Boulder, Colo.

[73] Assignee: LifeGear, Inc., Rockaway Township, N.J.

[21] Appl. No.: 621,292

[22] Filed: Mar. 22, 1996

[51] Int. Cl.[6] ..... A63B 21/078

[52] U.S. Cl. ..... 248/295.11; 248/219.4; 482/104

[58] Field of Search ..... 248/219.4, 295.11, 248/297.31, 224.8, 220.31, 222.51; 403/353, 108, 106; 482/104, 94

[56] References Cited

U.S. PATENT DOCUMENTS

| | | | |
|---|---|---|---|
| 4,412,678 | 11/1983 | Baynes | 248/219.4 X |
| 4,989,821 | 2/1991 | Wong | 248/297.31 X |
| 5,281,193 | 1/1994 | Colbo, Jr. | 482/104 |
| 5,346,448 | 9/1994 | Sollo | 482/104 |

FOREIGN PATENT DOCUMENTS

| | | | |
|---|---|---|---|
| 3423837 | 1/1986 | Germany | 482/104 |
| 3813356 | 11/1989 | Germany | 482/104 |

*Primary Examiner*—Alvin C. Chin-Shue
*Assistant Examiner*—Long Dinh Phan
*Attorney, Agent, or Firm*—David L. Davis

[57] ABSTRACT

A self-locking quick release bracket having a body which surrounds a support rod having a line of cavities. The body includes an internal projection adapted to be placed into a selected one of the cavities at a desired elevation along the rod. The body is so formed that it can be tilted relative to the rod to remove the projection from a cavity and allow the bracket to be moved longitudinally along the rod in order to change the location of the bracket on the rod.

5 Claims, 3 Drawing Sheets

SELF-LOCKING QUICK RELEASE BRACKET

BACKGROUND OF THE INVENTION

This invention relates to a load supporting bracket for use with a vertically oriented support rod and, more particularly, to such a bracket which is self-locking to the rod at a desired position and is also quickly releaseable for movement along the rod without the use of any tools.

The present invention finds particular utility in the environment of exercise equipment, especially weight benches. Modern weight benches typically have a floor supported base structure and, in addition to supports for the bench itself, also have upright support rods to which are mounted brackets utilized for holding weighted barbells. When different people utilize the weight bench, and also when a particular person proceeds through a regimen of different exercises, the height of the brackets on the rods is typically required to be changed. It is therefore a primary object of the present invention to provide such a bracket which can be quickly released from an existing position, moved to a new position, and locked into place without requiring the use of any tools.

SUMMARY OF THE INVENTION

The foregoing and additional objects are attained in accordance with the principles of this invention by providing a self-locking quick release bracket for use with a substantially vertical rod having cavities extending into the rod from a substantially vertical outer surface of the rod. The cavities are within a defined region of the rod, with the rod having a substantially uniform cross section within the defined region. The inventive bracket comprises a hollow tubular body having an internal cross section configured and sized relative to the cross section of the rod within the defined region so that the body is free to move along the rod within the defined region. The body has an upper portion encompassing a first part of the outer circumference of the rod including the cavities, a lower portion encompassing a second part of the outer circumference of the rod across the rod from the first part, and a central portion connecting the upper and lower portions. An inwardly directed projection is secured to the inner surface of the upper portion of the body, the projection being sized to fit within each of the cavities. When the projection is within a selected cavity, the bracket is prevented from being moved along the rod. The upper and lower portions of the body are spaced apart vertically a sufficient distance to allow the body to be tilted relative to the rod in a first angular direction so as to remove the projection from a cavity so that the tilted body can be moved along the rod.

In accordance with an aspect of this invention the bracket further includes a support member secured to the exterior surface of the lower portion of the body. The support member is adapted for supporting a load thereon so that when the projection is within a selected cavity and a load is supported by the support member the body is tilted in a second angular direction opposite the first angular direction to insure that the projection remains within the cavity.

In accordance with another aspect of this invention the body, the projection and the support member of the bracket are unitarily formed as an integral piece.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
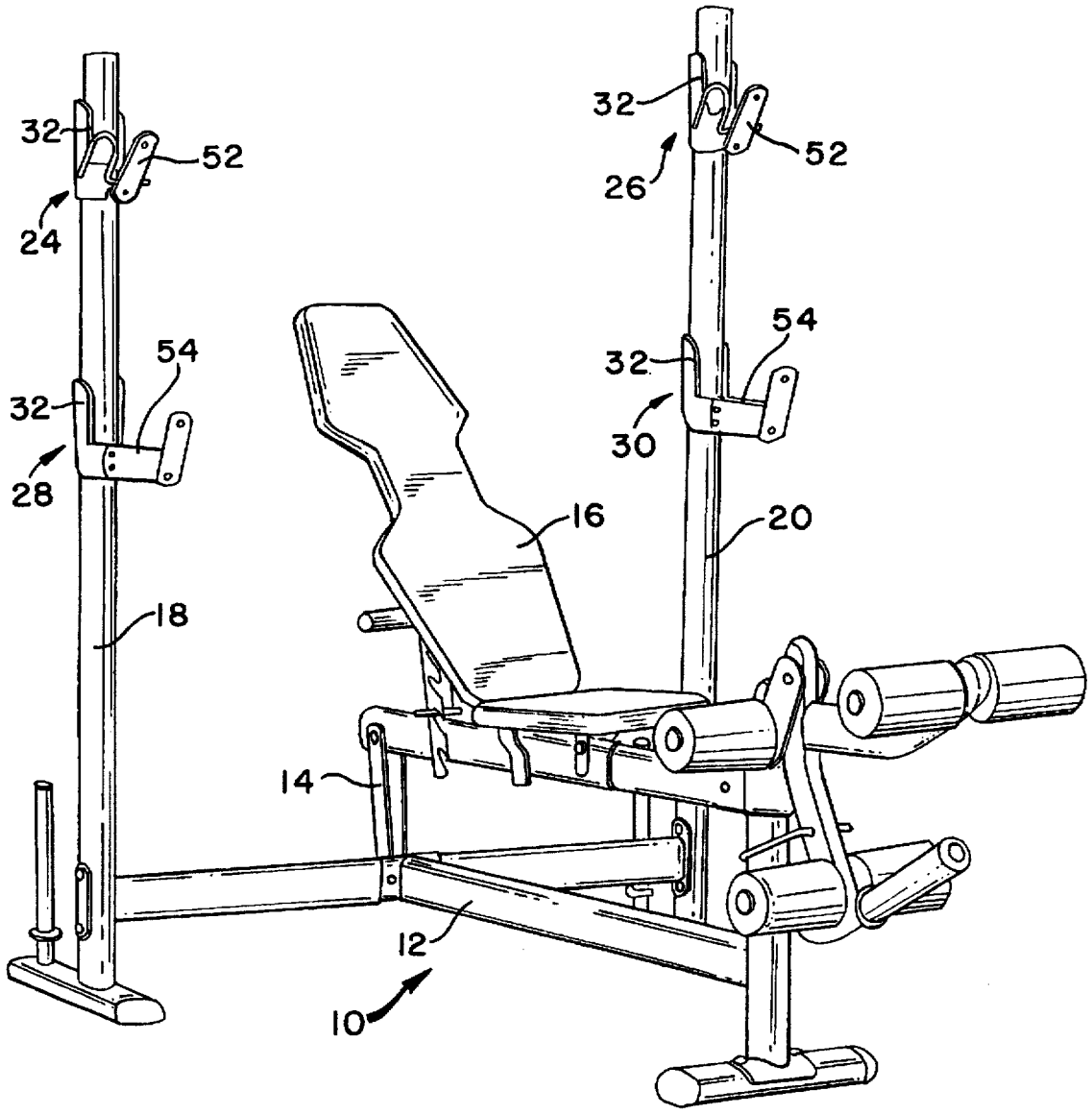
FIG. 1 is a perspective view of an illustrative weight bench utilizing a bracket constructed in accordance with the principles of this invention.

Referring to the drawings, FIG. 1 illustrates a weight bench, designated generally by the reference numeral 10, in which a bracket according to the present invention may be employed. The weight bench 10 includes floor supported base structure 12, bench support structure 14 for supporting a bench 16, and a pair of substantially vertical support rods 18, 20. Although shown as being generally oval in cross section, the rods 18, 20 can have any desired cross sectional configuration, such as circular or rectangular. The rods 18, 20 are illustratively hollow tubes and are each formed with a plurality of substantially identical cavities 22 (FIGS. 3 and 4) which are spaced longitudinally along each rod. Preferably, the cavities 22 are positioned along a straight line, at the rear of each of the rods 18, 20, as viewed in FIG. 1.

To support a weighted barbell during exercising, barbell holders 24, 26, 28 and 30 are provided. Each of the holders 24, 26, 28, 30 includes a bracket 32 (FIG. 2) according to the present invention, to which is secured a respective load holder, as will be described in full detail hereinafter. Thus, the two lower holders 28, 30 are typically referred to as spotter bars and the upper holders 24, 26 are typically referred to as holder bars.

Figure 2:
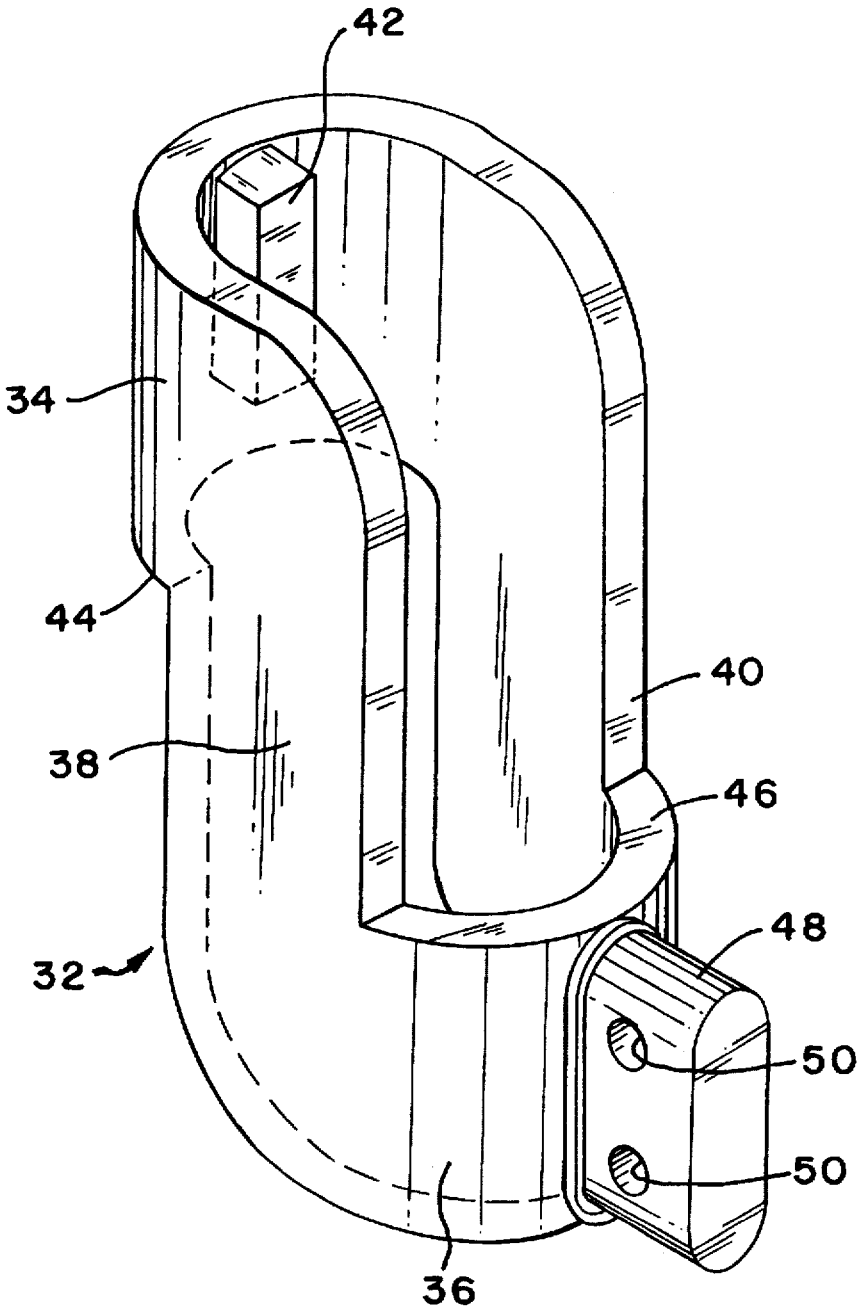
FIG. 2 is a perspective view of an illustrative embodiment of an inventive bracket.

As shown in FIG. 2, the inventive bracket 32 is preferably of unitary construction. In one embodiment, the bracket 32 is made from cast aluminum. Alternatively, the bracket 32 may be molded from a plastic material, or any other suitable material. As shown, the bracket 32 is a hollow tubular body. The cavities 22 in the rod 18 are all within a defined region of the rod 18, with this defined longitudinal region having a substantially uniform cross section. The internal cross section of the bracket 32 is configured and sized relative to the cross section of the rod 18 within the defined region so that the body of the bracket 32 has slight clearance around the rod 18. Thus, as illustrated, the rod 18 has a generally oval shape and therefore the interior of the bracket body is also preferably oval in shape.

Figure 4:
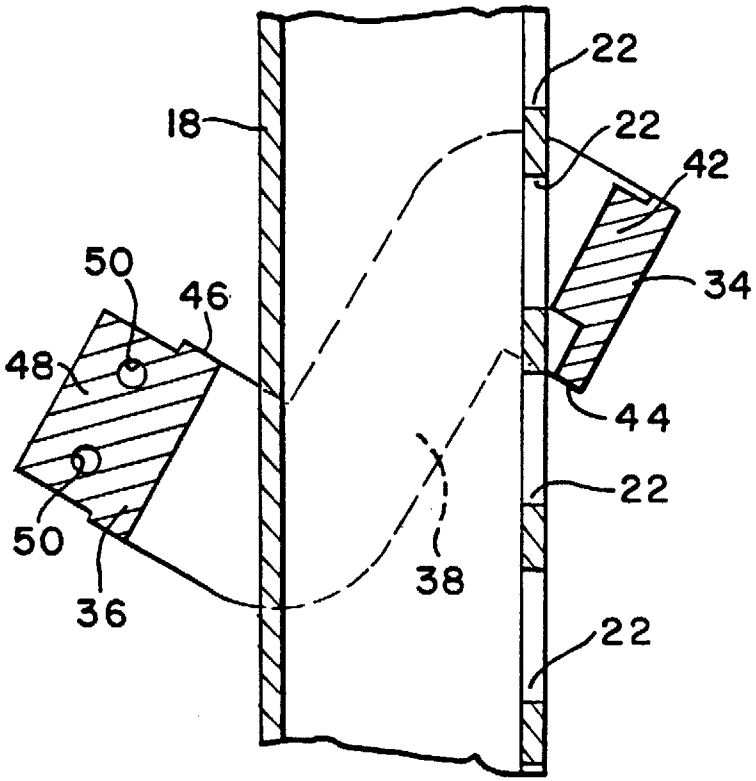
FIG. 4 is a view similar to FIG. 3 showing the inventive bracket released from the locked condition of FIG. 3 so that it is movable to a new position along the support rod.

The bracket 32 has an upper portion, or plate member, 34, a lower portion, or plate member, 36 and a central portion 38, 40 connecting the upper portion 34 and the lower portion 36. The upper portion 34 encompasses a first part of the outer circumference of the rod 18, the line of cavities 22 being within that first circumferential part. (Although shown with an oval cross section, the rod 18 could have a rectangular cross section. In that case, the cavities 22 would all be on a flat side of the rod and the upper and lower portions 34, 36 of the bracket 32 would be flat.) A projection 42 is secured to the inner surface of the upper portion 34 and is sized to fit within each of the cavities 22. As illustrated, the cavities 22 are elongated, so that the projection 42 is generally rectangular. However, both the cavities 22 and the projection 42 can have any other desired shape, such as circular. The lower portion 36 encompasses a second part of the outer circumference of the rod 18 across the rod 18 from the first circumferential part. The upper portion 34 has a lower extremity 44 and the lower portion 36 has an upper extremity 46 which are spaced apart longitudinally a sufficient distance to allow the bracket 32 to be tilted relative to the rod 18 in a first angular direction (clockwise as viewed in FIGS. 3 and 4). This tilting removes the projection 42 from whichever of the cavities 22 it was in, thereby allowing the bracket 32 to be moved along the rod 18, as best shown in FIG. 4. When the tilted bracket 32 is moved to a desired elevation along the rod 18, it is then tilted in a second angular direction (counterclockwise as viewed in FIGS. 3 and 4) to place the projection 42 within a selected one of the cavities 22, as shown in FIG. 3.

A support member 48 is secured to the exterior of the lower portion 36 of the bracket 32. The support member 48 is formed as an outwardly extending projection having a pair of apertures 50 which are utilized for mounting a selected load holder to the bracket 32. Thus, as shown in FIG. 1, the upper holders 24, 26 have relatively short load holders 52 mounted to their respective brackets 32, whereas the lower holders 28, 30 have relatively long load holders 54 mounted to their respective brackets 32.

Figure 3:
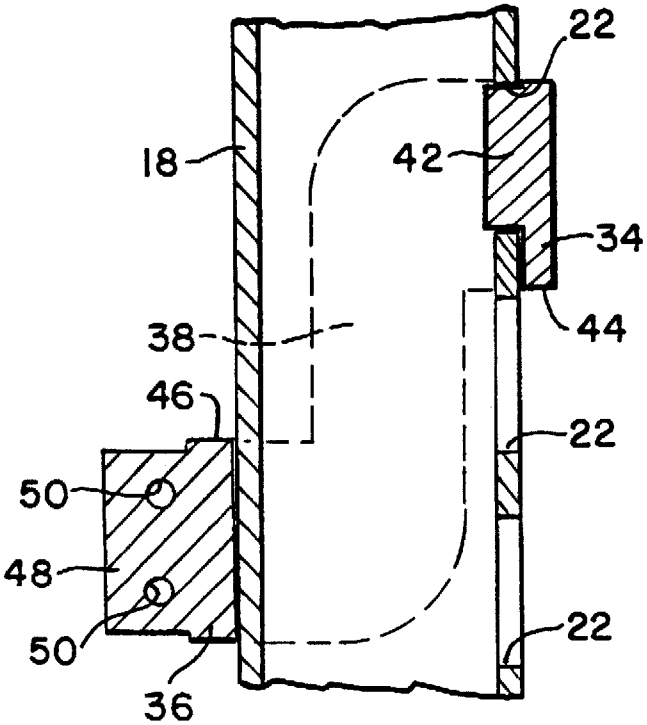
FIG. 3 is a cross sectional view showing an inventive bracket locked in place on a support rod.

As shown in FIG. 3, the weight of the support member 48, especially when a selected load holder 52, 54 is mounted thereto, causes the bracket 32 to be tilted in a counterclockwise direction. This insures that the projection 42 is maintained within a selected cavity 22 and also causes the lower edge of the lower portion 36 of the bracket 32 to dig into the front of the rod 18, thereby securely holding the bracket 32 in place.

Accordingly, there has been disclosed an improved self-locking quick release bracket. While an illustrative embodiment has been disclosed herein, it is understood that other embodiments and modifications may be apparent to those of ordinary skill in the art and it is intended that this invention be limited only by the scope of the appended claims. Thus, while the bracket has been described in the environment of a weight bench, it is readily apparent that it possesses utility in other environments as well, for example, as a support bracket in a shelving system wherein it is desired to be able to quickly and easily adjust the shelf heights.

What is claimed is:

1. A self-locking quick release bracket for use with a substantially vertical rod having at least one cavity extending into said rod from a substantially vertical outer surface of said rod, said at least one cavity being within a defined longitudinal region of said rod, said rod having a substantially uniform cross section within said defined longitudinal region, the bracket comprising:

a hollow tubular body adapted to move freely along said rod within said defined longitudinal region, said body having an upper portion adapted to encompass a first part of the outer circumference of said rod including said at least one cavity, said body having a lower portion adapted to encompass a second part of the outer circumference of said rod across said rod from said first part, and said body having a central portion connecting said upper and lower portions; and an inwardly directed projection secured to the inner surface of the upper portion of said body, said projection being sized to fit within each of said at least one cavity;

wherein said bracket is adapted so that when said projection is within a selected one of said at least one cavity, said bracket is prevented from being moved along said rod; and wherein said upper and lower portions of said body are spaced apart vertically a sufficient distance to allow said body to be tilted relative to said rod in a first angular direction so as to remove said projection from said at least one cavity so that said tilted body can be moved along said rod.

2. The bracket according to claim 1 further including a support member secured to the exterior surface of the lower portion of said body, said support member being adapted for supporting a load thereon so that when said projection is within a selected one of said at least one cavity and the load is supported by said support member the body is tilted in a second angular direction opposite said first angular direction.

3. The bracket according to claim 2 wherein said body, said projection and said support member are unitarily formed as an integral piece.

4. The bracket according to claim 2 wherein said support member includes means for removably mounting thereon a selected one of a plurality of load holders.

5. In combination with a substantially vertically oriented rod having a plurality of substantially identical cavities spaced longitudinally along the rod, a load supporting bracket comprising:

an upper plate member having a lower extremity and encompassing a first partial circumferential region of the rod, wherein each of said cavities is within said first region at its longitudinal position on the rod;

a projection secured to said upper plate member and sized to fit within each of said cavities;

a lower plate member having an upper extremity and encompassing a second partial circumferential region of the rod across the rod from said first region; and means for fixedly connecting said upper plate member to said lower plate member so that the transverse distance between said upper and lower plate members across said rod is maintained slightly greater than the transverse dimension of said rod and the longitudinal distance between said lower extremity of said upper plate member and said upper extremity of said lower plate member is sufficient to allow said bracket to be tilted to remove said projection from said plurality of cavities and allow said bracket to be moved longitudinally along said rod.

* * * * *